US005507063A

United States Patent [19]

Hirsch

[11] Patent Number: 5,507,063

[45] Date of Patent: Apr. 16, 1996

[54] DIFFUSE EDGE HAIR COLORING BRUSH

[76] Inventor: Leland Hirsch, 99 Seaview Blvd., Port Washington, N.Y. 11050-4362

[21] Appl. No.: 370,548

[22] Filed: Jan. 9, 1995

Related U.S. Application Data

[63] Continuation-in-part of Ser. No. 982,595, Nov. 27, 1992, abandoned.

[51] Int. Cl.[6] ..... A46B 9/02

[52] U.S. Cl. ..... 15/160; 15/207.2; 15/DIG. 5

[58] Field of Search ..... 15/160, 159.1, 15/166, 167.3, DIG. 5, 207.2, 201; 132/320, 112, 108; D4/127, 130, 132, 135

[56] References Cited

U.S. PATENT DOCUMENTS

| | | | |
|---|---|---|---|
| Re. 16,869 | 2/1928 | Goldman | 15/167.3 |
| D. 96,695 | 8/1935 | Porter | 15/143.1 |
| D. 110,363 | 7/1938 | Racicot | 15/160 |
| D. 306,493 | 3/1990 | Pessis | D11/135 |
| 1,958,134 | 5/1934 | Dike | 15/160 |
| 1,990,619 | 2/1935 | Schumann | 15/159.1 |
| 2,610,637 | 9/1952 | Fuentes | 132/19 |
| 3,346,900 | 10/1967 | Stewart et al. | 15/160 |
| 3,349,781 | 10/1967 | Poole et al. | 132/7 |
| 4,360,940 | 11/1982 | Smith | 15/160 |
| 4,590,637 | 5/1986 | Marino | 15/160 |
| 4,730,361 | 3/1988 | Koffler | 15/160 |
| 4,756,039 | 7/1988 | Pardo | 15/160 |
| 4,998,315 | 3/1991 | Pessis | 15/160 |

FOREIGN PATENT DOCUMENTS

| | | | |
|---|---|---|---|
| 1512586 | 1/1968 | France | 15/160 |
| 876233 | 7/1949 | Germany | 15/160 |
| 833944 | 7/1949 | Germany | 15/201 |
| 3538653 | 5/1987 | Germany | 132/320 |
| 14405 | 4/1897 | Switzerland | 15/159.1 |
| 12929 | of 1885 | United Kingdom | 15/159 R |
| 276523 | 9/1927 | United Kingdom | 15/166 |
| 783355 | 9/1957 | United Kingdom | 15/160 |

*Primary Examiner*—Timothy F. Simone
*Assistant Examiner*—Tony G. Soohoo
*Attorney, Agent, or Firm*—Oltman and Flynn

[57] ABSTRACT

A brush for applying coloring matter to hair includes a rack having two ends for holding a row of bristles, the ends of the bristles forming an essentially flat tip surface portion and a tapered surface portion extending from the flat tip surface portion generally toward the rack. The tip surface portion may be provided opposite one rack end, with one tapered surface portion extending to the other rack end. Equivalently, the tip surface portion has two sides and is located midway between the rack ends, with one tapered surface portion extending from either side of the tip surface portion to the rack ends. In another equivalent configuration, one tip surface portion is provided opposite each rack end, and one tapered surface portion extends from each tip surface portion toward the other tip surface portion so that the tapered surface portion converge between the tip surface portion. In still another equivalent configuration, one tip surface portion is provided at each rack end, and another tip surface portion is provided midway between the rack ends, and one tapered surface portion extends from each tip surface portion toward each adjacent tip surface portion so that the tapered surface portion converge between adjacent tip surface portion.

6 Claims, 3 Drawing Sheets

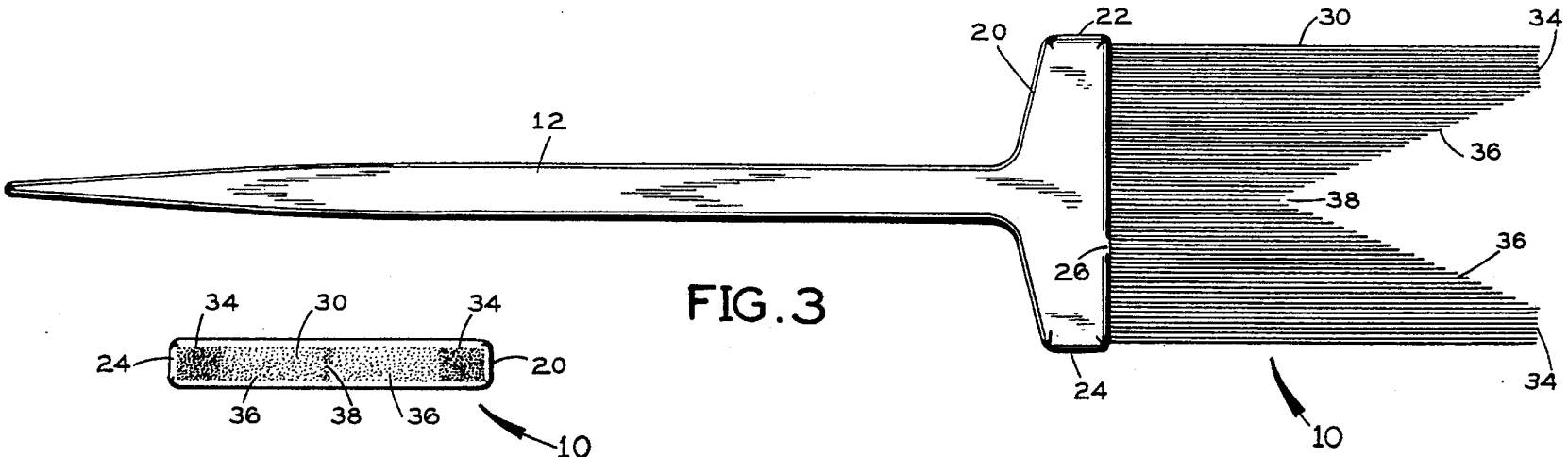
FIG. 3
FIG. 3a
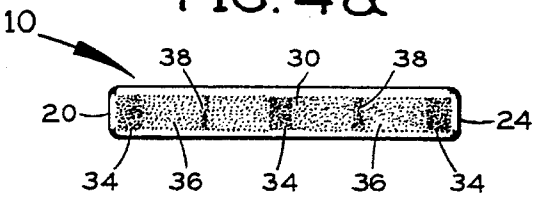
FIG. 4a
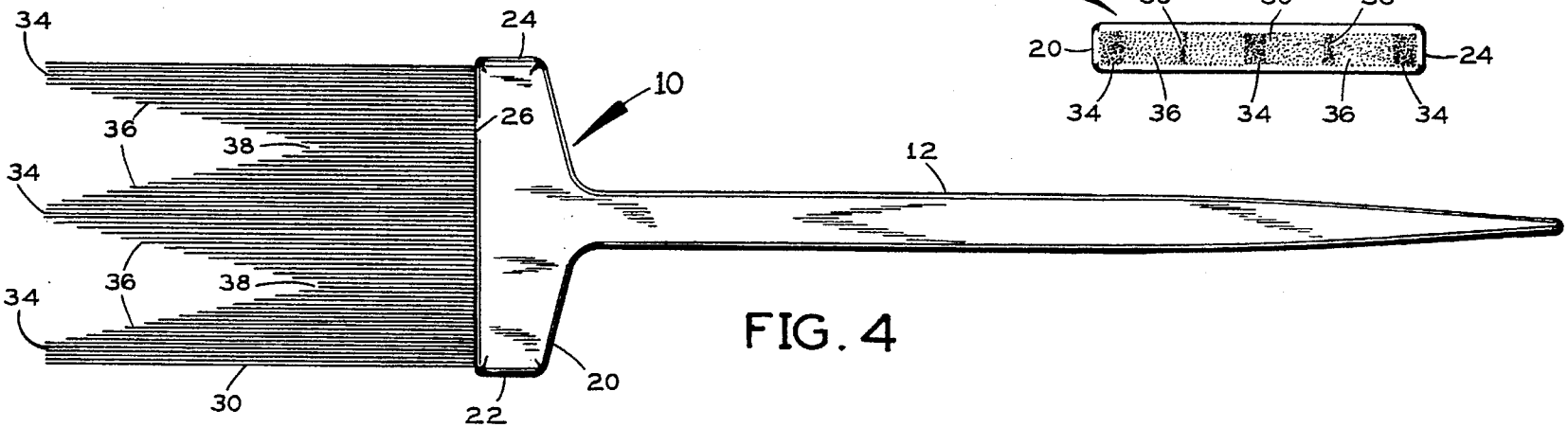
FIG. 4

DIFFUSE EDGE HAIR COLORING BRUSH

FILING HISTORY

This application is a continuation-in-part of application Ser. No. 07/982,595 filed on Nov. 27, 1992, now abandoned.

BACKGROUND OF THE INVENTION

1. Field of the Invention

The present invention relates generally to the field of brushes for applying coloring matter to hair, and more specifically to a brush which applies such matter as defined in this application in gradually diminishing amounts at the edges of a stroke so that the applied color diffuses and blends with the existing hair color, the brush having an elongate handle portion connected to a bristle support rack having two ends and a plurality of perpendicularly protruding bristles, the bristles preferably being flexible and resilient, and protruding to form at least one edge segment of maximum bristle length, and then tapering toward at least one rack end to gradually reduce bristle pressure, bristle contact and the transfer of coloring matter at stroke edges.

2. Description of the Prior Art

There have long been brushes for applying and removing various materials to and from work surfaces. A problem with these prior art brushes when used for applying coloring matter to hair is that they apply the matter in uniform strokes, so that a sharp and unnatural color contrast is visible at the stroke edges.

Pessis, U.S. Pat. No. 4,998,315, issued on Mar. 12, 1991, discloses a nail polish brush having an essentially cylindrical cluster of bristles tapered at its distal end to give a sharper tip, and contoured to conform to the curvature of the nail. The taper is intended to give greater control and to minimize polish application to unwanted areas. The curved contour is intended to fit the nail to make possible a uniform single stroke application. A problem with Pessis, if applied to hair coloring, is that the uniform application of fluid matter would create sharp streaks of hair color with distinct, unnaturally contrasting edges. Another problem is that the narrow tip provides a very small application area, so that a great many strokes would be needed to color a head of hair.

Koffler, U.S. Pat. No. 4,730,361, issued on Mar. 15, 1988, teaches a hair brush for lifting and shaping hair, having rows of bristles tapered across their width, but uniform along their length. This tapering causes the hair to be contacted by successively shorter rows of bristles. The longer rows first lift and shape the hair, and then the shorter rows smooth and pat the hair. Once again, a problem with Koffler when used for applying coloring matter to hair is that each stroke leaves sharp, unnatural looking color edges, regardless of any lifting or shaping Koffler may provide.

Pardo, U.S. Pat. No. 4,756,039, issued on Jul. 12, 1988, reveals an angle cut broom. The Pardo broom has a row of bristles tapered lengthwise from one end to the other, to permit improved sweeping of flat surfaces as well as of corners and edges. The bristles at one end are also stiffer than those at the other, for increased sweeping efficiency in corners and edges. A problem with Pardo is that the entire bristle end surface is angled, so that if this bristle arrangement were used to apply hair coloring matter, either a single line contact with long end bristles is made, or full planar contact is made by angling the brush. In the former instance, the very narrow application stroke would make application of hair color extremely time consuming. In the latter instance, the above described uniform strokes with unnatural sharp color edges would be created.

Marino, U.S. Pat. No. 4,590,637, issued on May 27, 1986, discloses a paint brush having the across-width taper of Koffler. The taper from one broad bristle face to the other is supposed to make the brush more versatile, so that the ends can fit more easily into corners and edges. A problem presented by the Marino design, if used for applying hair coloring matter, is the same as that of Koffler; namely, sharp color streak edges result if applied broad face. If applied by a tapered, narrow bristle end, the problem presented is that of Pardo; namely, the need for numerous strokes.

Smith, U.S. Pat. No. 4,360,940, issued on Nov. 30, 1982, teaches a corner cleaning brush. The Smith brush has a flat bristle head with a substantially rectangular body section tapered to form a protruding nose portion. Rows of bristles angle outward at the nose portion and taper to a sharp central line across the width of the bristle head. The only noticeable difference between Smith and Marino is that the taper starting line is along the middle rather than the edge of the bristle head width. Despite this difference, Smith presents the problems identified above for Marino.

Poole, U.S. Pat. No. 3,349,781, issued on Oct. 31, 1987, discloses a hair coloring method and brush for creating color streaks in hair. The brush has spaced apart tufts of bristles to produce discrete and distinct streaks having sharply defined edges. Poole may be suitable if streaks are desired, but the Poole brush presents a problem where natural color blending is preferred. Since the objective of Poole is to create distinct streaks, it teaches away from the objectives of the present invention.

Fuentes, U.S. Pat. No. 2,610,637, issued on Sep. 16, 1952, reveals a combined comb and brush structure. The body of the structure has a row of comb teeth extending from a concave edge portion so that their free extremities define an arcuate path. The arcuate path of the comb teeth conform to the curvature of a person's head. There is a flat face on either side of the concave edge. Bristles protrude from one of these faces and are radially spaced from the free ends of the comb teeth. A problem with Fuentes is that the brush is too wide for adequate control in applying hair coloring matter. Another problem is that the radial spacing of the bristles does not prevent the formation of distinct color contrast along either edge of a stroke.

It is thus an object of the present invention to provide a brush for applying hair coloring matter to a head of hair so that the edges of a brush stroke are diffuse and blend applied color with existing color.

It is another object of the present invention to provide such a brush which can be offered in several variations to accommodate various individual styling needs.

It is finally an object of the present invention to provide such a brush which is of reliable design, and simple and inexpensive to manufacture.

SUMMARY OF THE INVENTION

The present invention accomplishes the above-stated objectives, as well as others, as may be determined by a fair reading and interpretation of the entire specification.

A brush is provided for applying coloring matter to hair, including a rack having two ends for holding a row of bristles, the ends of the bristles forming an essentially flat tip surface portion and a tapered surface portion extending from the flat tip surface portion generally toward the rack. The tip surface portion may be provided opposite one rack end, with one tapered surface portion extending to the other rack end. Equivalently, the tip surface portion has two sides and is located midway between the rack ends, with one tapered surface portion extending from either side of the tip edge to the rack ends. In another equivalent configuration, one tip surface portion is provided opposite each rack end, and one tapered surface portion extends from each tip surface portion toward the other tip surface portion so that the tapered surface portion converge between the tip surface portion. In still another equivalent configuration, one tip surface portion is provided at each rack end, and another tip surface portion is provided midway between the rack ends, and one tapered surface portion extends from each tip surface portion toward each adjacent tip edge so that the tapered surface portion converge between adjacent tip surface portion.

BRIEF DESCRIPTION OF THE DRAWINGS

Various other objects, advantages, and features of the invention will become apparent to those skilled in the art from the following discussion taken in conjunction with the following drawings, in which:

FIG. 3 shows still another embodiment where a bristle tip surface portion is provided opposite each rack end, and tapered surface portion extend from each tip surface portion to a central converging point.

FIG. 3*a* is an end view of the apparatus of FIG. 3.

FIG. 4 shows a more complex embodiment, with a bristle tip surface portion at each rack end, and a bristle tip surface portion midway between the rack ends, with tapered surface portion converging between adjacent tip surface portion. For all of these embodiments, each tip surface portion leaves a path of coloring matter, diffused at at least one of its surface portion by a tapered bristle surface portion.

FIG. 4*a* is an end view of the apparatus of FIG. 4.

DETAILED DESCRIPTION OF THE PREFERRED EMBODIMENTS

Figure 1:
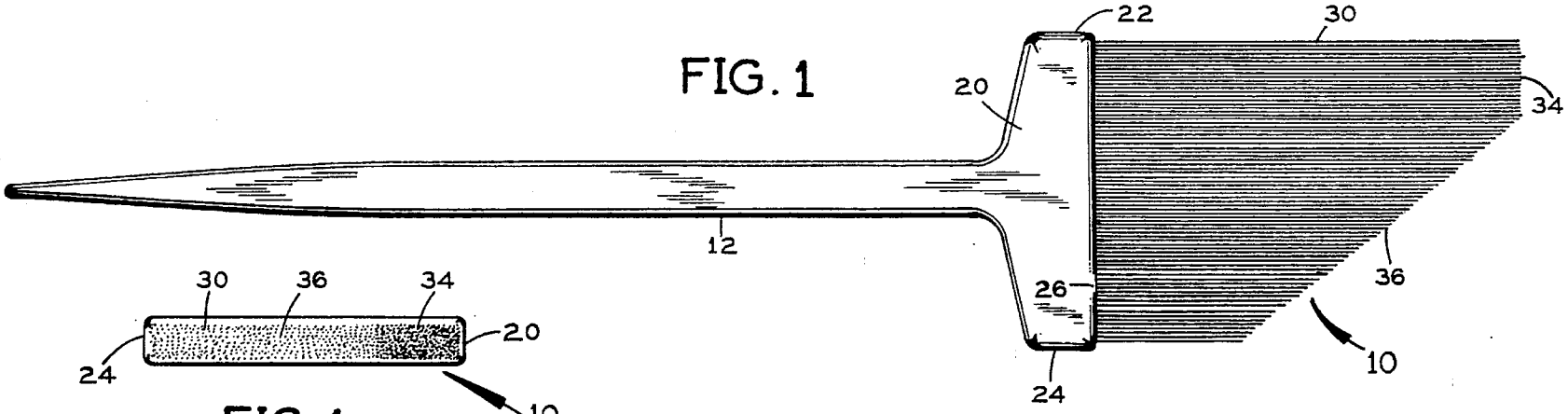
FIG. 1 shows one embodiment of the inventive hair coloring brush, where a bristle tip surface portion is provided opposite one rack end, and a tapered surface portion extends all the way to the other rack end.
Figure 1A:
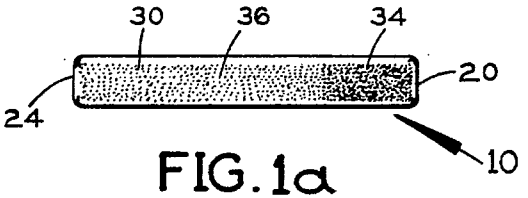
FIG. 1*a* is an end view of the apparatus of FIG. 1, looking directly at the tips of the bristles along the longitudinal axes of the bristles.
Figure 1B:
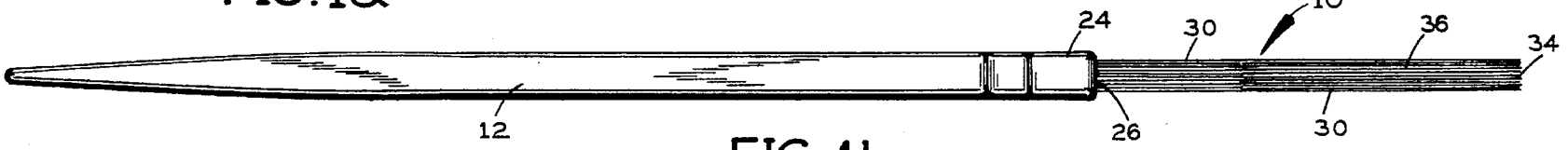
FIG. 1*b* is a side view of the apparatus of FIG. 1.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

Preferred Embodiments

Referring to FIGS. 1 through 4, a brush 10 is disclosed for applying coloring matter to hair in strokes with diffuse edges so that the applied color blends with existing hair color for a more natural, pleasing appearance. The term "coloring matter" for purposes of this application is understood to include all substances which are used to color, bleach, highlight, frost, paint, or produce any hair coloring special effects.

Brush 10 has an elongate handle portion 12 connected to a bristle support rack 20 having two ends 22 and 24, a longitudinal bristle mounting face 26, and a plurality of bristles 30. Bristles 30 protruding perpendicularly from mounting face 26, are substantially uniformly thick, flexible and resilient per unit length, and form at least one tip edge 34 of maximum bristle length. Bristles 30 taper toward at least one rack end 22 or 24 so that bristle 30 pressure, bristle 30 contact and the transfer of coloring matter gradually diminishes and blends at the edges of a brush 10 stroke. A single row or multiple rows of bristles 30 may equivalently be provided on brush 10.

Figure 6:
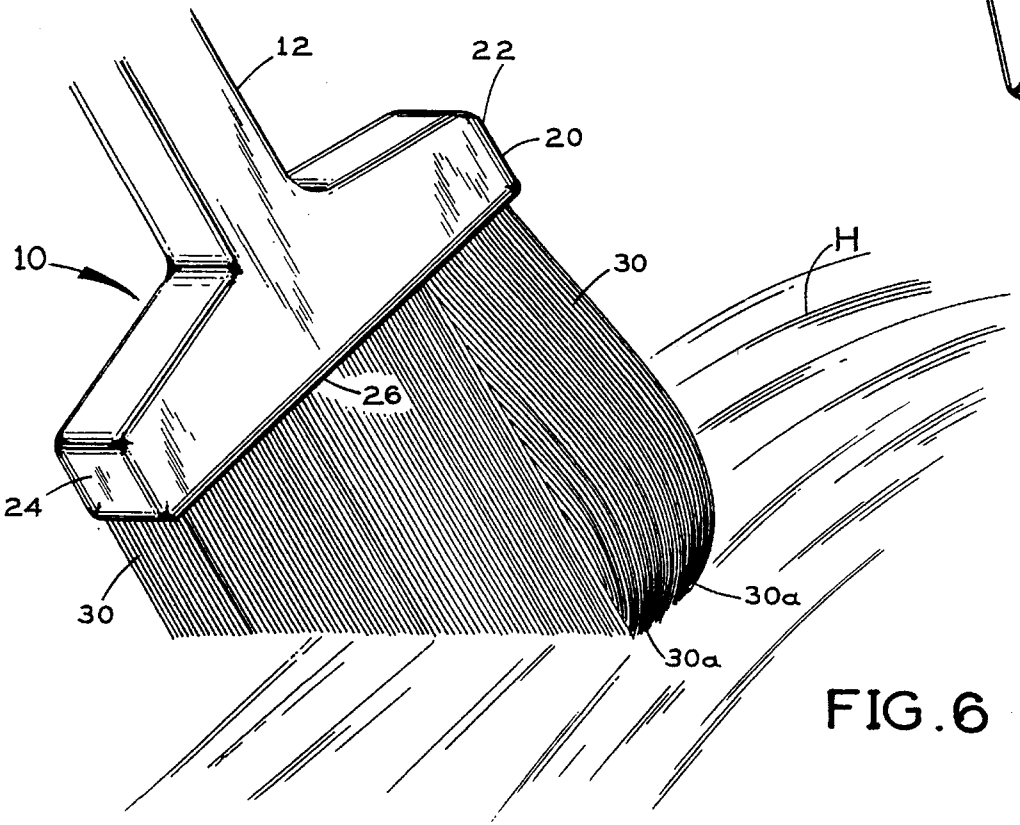
FIG. 6 is a side view of a brush having only one short bristle and one long bristle, showing how the different reach of the bristles together with the varying stiffness relative to length influences the extent of bristle side surface making contact with the hair H and depositing coloring matter on hair H.

Standard brushes have straight bristle tip edges which apply coloring matter in straight lines, and when hair grows, they leave a line of demarcation. Mounting face 26 is oriented substantially parallel to the hair surface to which coloring matter is applied during application. As a result of bristle 30 perpendicularity to mounting face 26, bristles 30 become shorter as they angle away from tip surface portion 34 and from the hair to which coloring matter is applied. It is a property of any bristle 30 or other flexible and uniform elongate member that the shorter it is, the more resistant it is to bending. Bristles 30 deposit progressively less coloring matter on the hair across tapered tip surface portion 36 in part because the bristle 30 tips recede away from the hair due to the angle of surface portion 36. See FIG. 6. Yet bristles 30 also deposit progressively less coloring matter in this receding direction along surface portion 36 because the shorter bristles 30 are stiffer due to their shorter length and bend less, presenting a shorter bristle 30 bent side segment 30*a* to bear against the hair. Contact with the hair applies a lateral load or moment to a bristle 30. Shorter bristles 30 make contact with a person's hair at a shorter distance from their mounting points in mounting face 26. Since the bristles 30 are of substantially uniform cross-sectional area and resilience per unit of length, shorter bristles 30 bend less than longer bristles 30 with their smaller moment. The less a shorter bristle 30 bends, the less bristle 30 side surface 30*a* makes contact with the hair. Coloring matter clinging to the side surface 30*a* of the bristle 30 is deposited on the hair only from the segment of side surface 30*a* making contact with the hair. Thus the less side surface 30*a* contact between a bristle 30 and the hair, the less coloring matter is deposited onto the hair from the given bristle 30. Shorter bristles 30 make less side surface 30*a* contact than longer bristles 30 because they are stiffer and bend less relative to their length, and so shorter bristles 30 deposit less coloring matter. In summary, two factors work inventively and synergistically together to produce the diminishing, diffuse edge coloring effect: (1) the progressively shorter bristles 30 angle away from the hair during a brush 10 stroke to make progressively less contact, and (2) the progressively shorter bristles 30 also are progressively stiffer relative to their length and bend less relative to their length as a result of less leverage but the same bristle 30 composition and thickness, thus resting less of their coloring matter laden side surfaces 30*a* against the hair. The second factor would not be present were the mounting surface 26 to angle with the bristle tip surface 30*a*, because the bristles 30 would not become progressively shorter and stiffer, but would instead be of uniform length. This combined diffuse edge producing effect is a key inventive feature of the present invention. This result differs from the full, straight lines of coloring matter deposited by standard brushes. In this way, brush 10 gives hair a more natural effect than brushes which are totally straight-tipped.

Figure 2A:
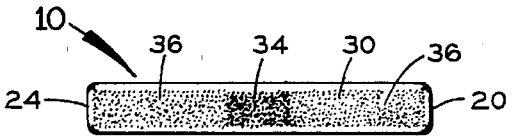
FIG. 2*a* is an end view of the apparatus of FIG. 2.
Figure 2:
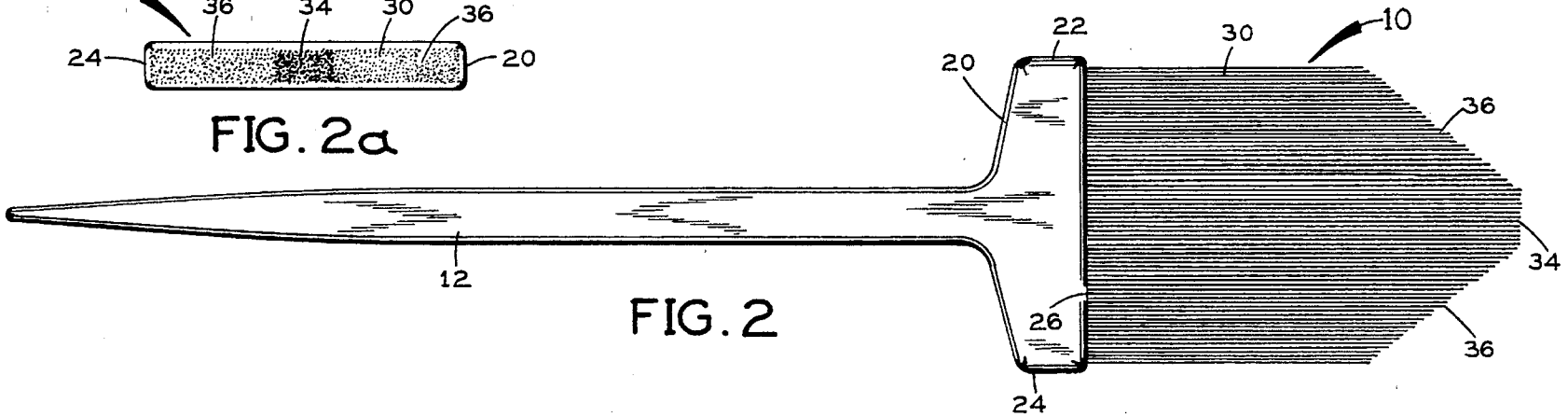
FIG. 2 shows another embodiment having a centrally located bristle tip surface portion, and tapered surface portion on either side of the tip surface portion all the way to either rack end.
Figure 5:
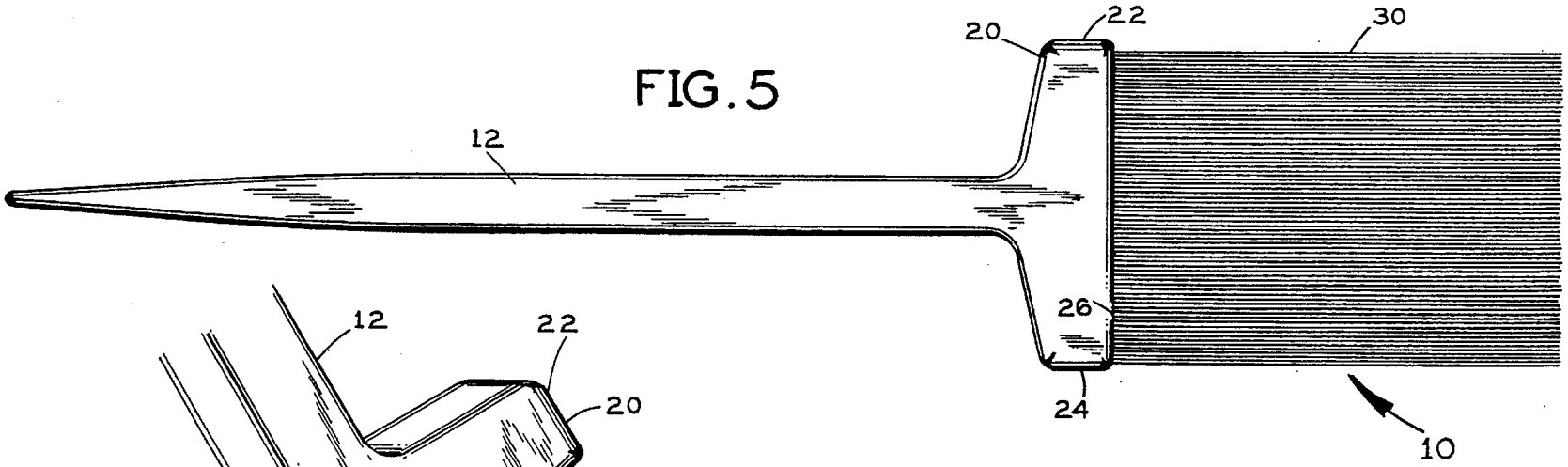
FIG. 5 shows the basic brush from which the various inventive configurations are manufactured.
Figure 5A:
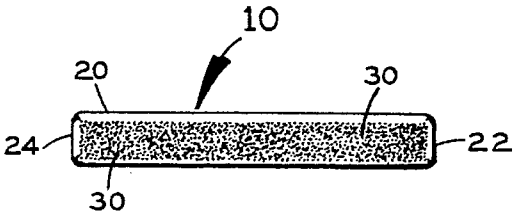
FIG. 5*a* is an end view of the apparatus of FIG. 5.

The numbers and locations of tip surface portion 34 and the manner of tapering can be varied depending on individual styling requirements. FIG. 1 shows the simplest configuration, where a tip surface portion 34 is provided opposite one rack end 22, and a tapered surface portion 36 extends from tip surface portion 34 all the way to the other rack end 24. FIG. 2 shows a centrally located tip surface portion 34, and tapered surface portions 36 on either side of the tip surface portion extending all the way to rack ends 22 and 24. FIG. 3 shows a tip surface portion 34 opposite each rack end 22 and 24, and tapered edges 36 extending from each tip surface portion 34 to a central converging point 38. FIG. 4 shows a more complex bristle 30 configuration, with a tip surface portion 34 at each rack end 22 and 24, and a tip surface portion 34 midway between rack ends 22 and 24, with tapered surface portions 36 converging between adjacent tip surface portion 34 at points 38. Each tip surface portion 34 leaves a path of coloring matter which is diffused at at least one of its edges by a tapered surface portion 36. FIG. 5 illustrates the preferred basic brush from which the various embodiments are manufactured.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. An apparatus for applying a diffuse edge streak of coloring matter, comprising:

a tuft of substantially parallel strands of hair, said strands having lateral strand surfaces, and said tuft being a plurality of said strands in depth and presenting an outer tuft composite surface comprising a plurality of said lateral strand surfaces of substantially adjacent said strands, an elongate rack having two ends and a bristle mounting face extending between said two ends for holding a row of bristles for dipping into said coloring matter, said bristles extending substantially perpendicularly from said bristle mounting face and having longitudinal axes, attached ends secured to said bristle mounting face and having free ends and being of a material sufficiently soft and nonabrasive for applying said coloring matter to said outer tuft composite surface, said bristles having tips and side surfaces for retaining some of said coloring matter when said bristles are dipped into said coloring matter and for delivering some of said coloring matter to said outer tuft composite surface, said free ends of said bristles forming a bristle surface and being divided into at least one first surface portion having a substantially uniform depth and having a first surface portion area and being substantially perpendicular to said longitudinal axes of said bristles for applying said coloring matter directly and in high concentration to a first area of said outer tuft composite surface and at least one second edge having a second surface portion area which is greater than said first surface portion area and angled relative to said first surface portion generally toward said rack for applying a progressively diminishing concentration of said coloring matter to a second area of said outer tuft composite surface adjacent to said first area of said outer tuft composite surface.

2. An apparatus according to claim 1, wherein said first surface portion is provided opposite one said rack end, and one said second surface portion extends to said other rack end.

3. A brush according to claim 1, wherein said bristle surface comprises two said second surface portions extending from opposing sides of said first surface portion and having substantially equivalent second surface portion areas.

4. A brush according to claim 1, wherein one said first surface portion is provided opposite each said rack end, and one said second surface portion extends from each said first surface portion toward the other said first surface portion so that said second surface portions converge between said first surface portions.

5. A brush according to claim 1, wherein one said first surface portion is provided at each said rack end, and another said first surface portion is provided midway between said rack ends, and one said second surface portion extends from each said first surface portion toward each adjacent first surface portion so that said second surface portions converge between said adjacent first surface portions.

6. An apparatus for applying a diffuse edged streak of coloring matter, comprising:

a tuft of substantially parallel and flexible strands of material, said strands having lateral strand surfaces, and said tuft being a plurality of said strands in depth and presenting an outer tuft composite surface comprising a plurality of said lateral strand surfaces of substantially adjacent said strands, an elongate rack having two ends and a bristle mounting face extending between said two ends for holding a row of bristles for dipping into said coloring matter, said bristles extending substantially perpendicularly from said bristle mounting face and having longitudinal axes, attached ends secured to said bristle mounting face and having free ends and being of a material sufficiently soft and nonabrasive for applying said coloring matter to said outer tuft composite surface, said bristles having tips and side surfaces for retaining some of said coloring matter when said bristles are dipped into said coloring matter and for delivering some of said coloring matter to said outer tuft composite surface, said free ends of said bristles forming a bristle surface and being divided into at least one first surface portion having a substantially uniform depth and having a first surface portion area and being substantially perpendicular to said longitudinal axes of said bristles for applying said coloring matter directly and in high concentration to a first area of said outer tuft composite surface and at least one second surface portion having a second surface portion area which is greater than said first surface portion area and angled relative to said first surface portion generally toward said rack for applying a progressively diminishing concentration of said coloring matter to a second area of said outer tuft composite surface adjacent to said first area of said outer tuft composite surface.

* * * * *